US007975337B2

(12) United States Patent
Howell

(10) Patent No.: US 7,975,337 B2
(45) Date of Patent: Jul. 12, 2011

(54) FLUIDIZED BED

(75) Inventor: Charles A. Howell, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 37 days.

(21) Appl. No.: 12/543,531

(22) Filed: Aug. 19, 2009

(65) Prior Publication Data

US 2011/0041254 A1 Feb. 24, 2011

(51) Int. Cl.
*A61G 7/057* (2006.01)

(52) U.S. Cl. ..... 5/689; 5/702; 5/911

(58) Field of Classification Search ..... 5/689, 702, 5/655.4, 911

See application file for complete search history.

(56) References Cited

U.S. PATENT DOCUMENTS 3,670,347 A 6/1972 Weinstein
4,599,755 A * 7/1986 Tominaga ..... 5/689
4,694,521 A * 9/1987 Tominaga ..... 5/689
4,879,777 A * 11/1989 Goodwin ..... 5/689
5,008,965 A 4/1991 Vrzalik
5,036,559 A * 8/1991 Hargest ..... 5/689
5,072,468 A 12/1991 Hagopian
5,623,736 A * 4/1997 Soltani et al. ..... 5/689
6,574,813 B2 * 6/2003 Bolden et al. ..... 5/689
7,454,807 B1 11/2008 Mardan et al.

* cited by examiner

*Primary Examiner* — Michael Trettel
(74) *Attorney, Agent, or Firm* — Jason Penninger

(57) ABSTRACT

A person-support apparatus comprises a frame, a container, a gas permeable cover, a rigid diffuser, a fluidizable medium, and a cushion. The container is supported on a frame and includes a base and a plurality of sides coupled to the base. The base cooperates with the sides to define an opening opposite the base. The gas permeable cover is removably coupled to the container and covers the opening to define a chamber. The rigid diffuser is positioned within the chamber proximate the base. The fluidizable medium is positioned between the rigid diffuser and the gas permeable cover. The cushion is coupled to the diffuser and positioned between the gas permeable cover and the rigid diffuser. The cushion is configured to provide cushioning support between a person supported on the gas permeable cover and the rigid diffuser.

29 Claims, 8 Drawing Sheets

FLUIDIZED BED

BACKGROUND OF THE DISCLOSURE

This disclosure relates generally to fluidized person-support apparatuses. More particularly, but not exclusively, one illustrative embodiment relates to a fluidized person-support apparatus with a cushion on a diffuser.

Some people can be required to remain on person-support apparatuses for extended periods of time. In some instances, pressure on tissues that interface with the person-support apparatus can be comparably higher at or near protuberances of the surface of the body, such as, for example, the heels, the buttocks, and the head. The high interface pressures can increase the probability that pressure sores or decubitus ulcers will develop over time. Fluidized person-support apparatuses can be used to help reduce the interface pressures by fluidizing granular medium to buoyantly suspend a person supported thereon, thereby increasing the surface area being supported and helping distribute the interface pressure points substantially uniformly there along. Occasionally people can come into contact with surfaces of a tank containing the granular medium, which can cause the tissue interface pressure to increase. While various fluidized person-support apparatuses have been developed, there is still room for improvement. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a fluidized person-support apparatus with a tank having a diffuser positioned therein and a cushion coupled to the diffuser.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
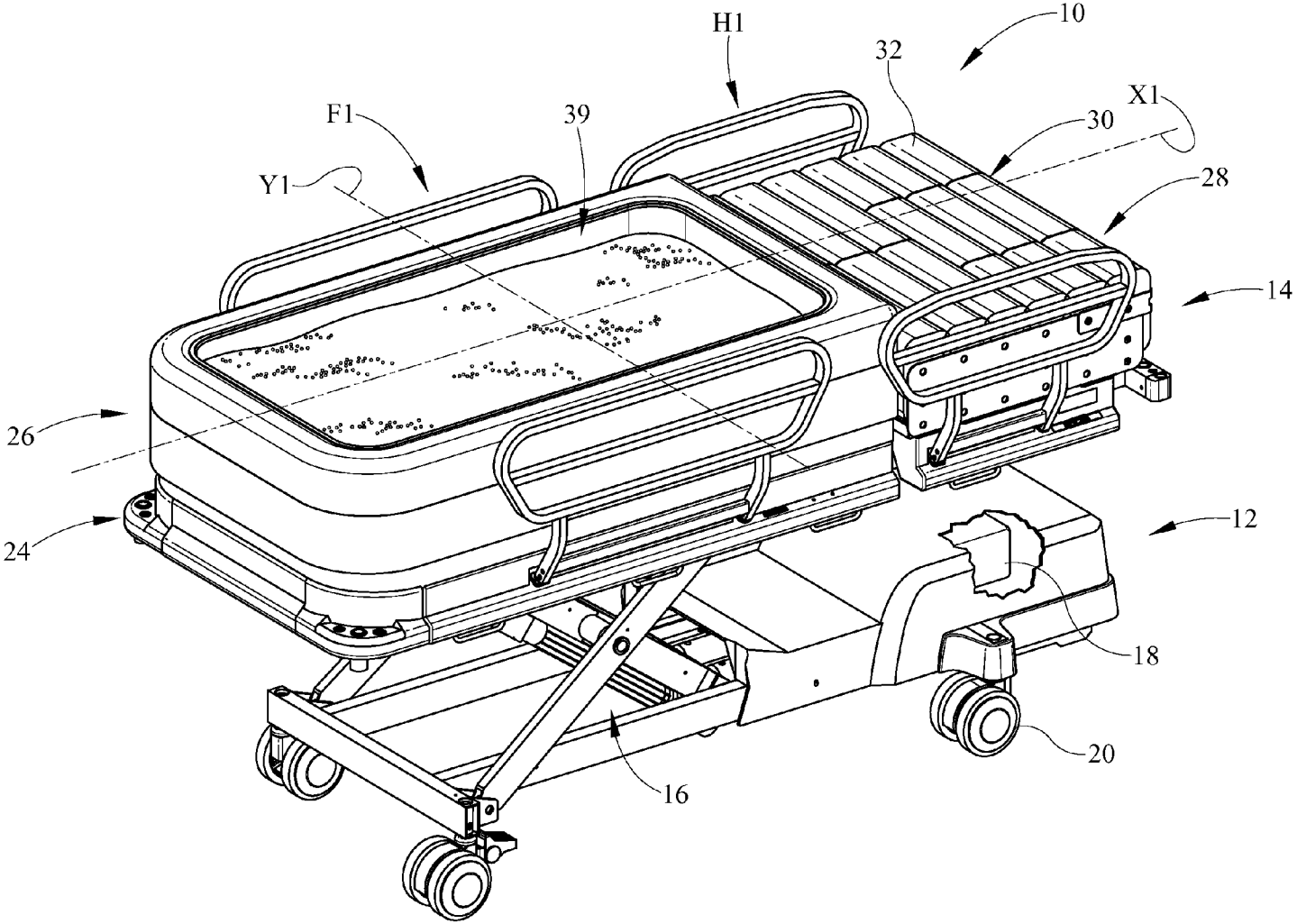
FIG. 1 is a perspective side view of a fluidized person-support apparatus according to one illustrative embodiment.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a fluidized person-support apparatus with a tank having a diffuser positioned therein and a cushion coupled to the diffuser.

A person-support apparatus 10 according to one illustrative embodiment of the current disclosure is shown in FIGS. 1-7. The person-support apparatus 10 can be a fluidized hospital bed and can include a head section H1, where the head of a person (not shown) is positioned, and a foot section F1, where the feet of a person (not shown) are positioned. The person-support apparatus 10 can include a lower frame 12, an upper frame 14, a plurality of supports 16 supporting the upper frame 14 on the lower frame 12, and a gas supply unit 18. The lower frame 12 can be supported on casters 20 and can be coupled with the supports 16 to support the supports 16 and the upper frame 14.

In one illustrative embodiment, the supports 16 can be coupled with the lower frame 12 and the upper frame 14 and can movably support the upper frame 14 above the lower frame 12 as shown in FIG. 1. The supports 16 can be lift mechanisms 16 with a lift driver (not shown) that can cause the lift mechanisms 16 to expand and/or contract to raise and/or lower the upper frame 14 with respect to the lower frame 12. In another illustrative embodiment, the supports 16 can fixedly support the upper frame 14 above the lower frame 12 as shown in FIG. 2.

Figure 2:
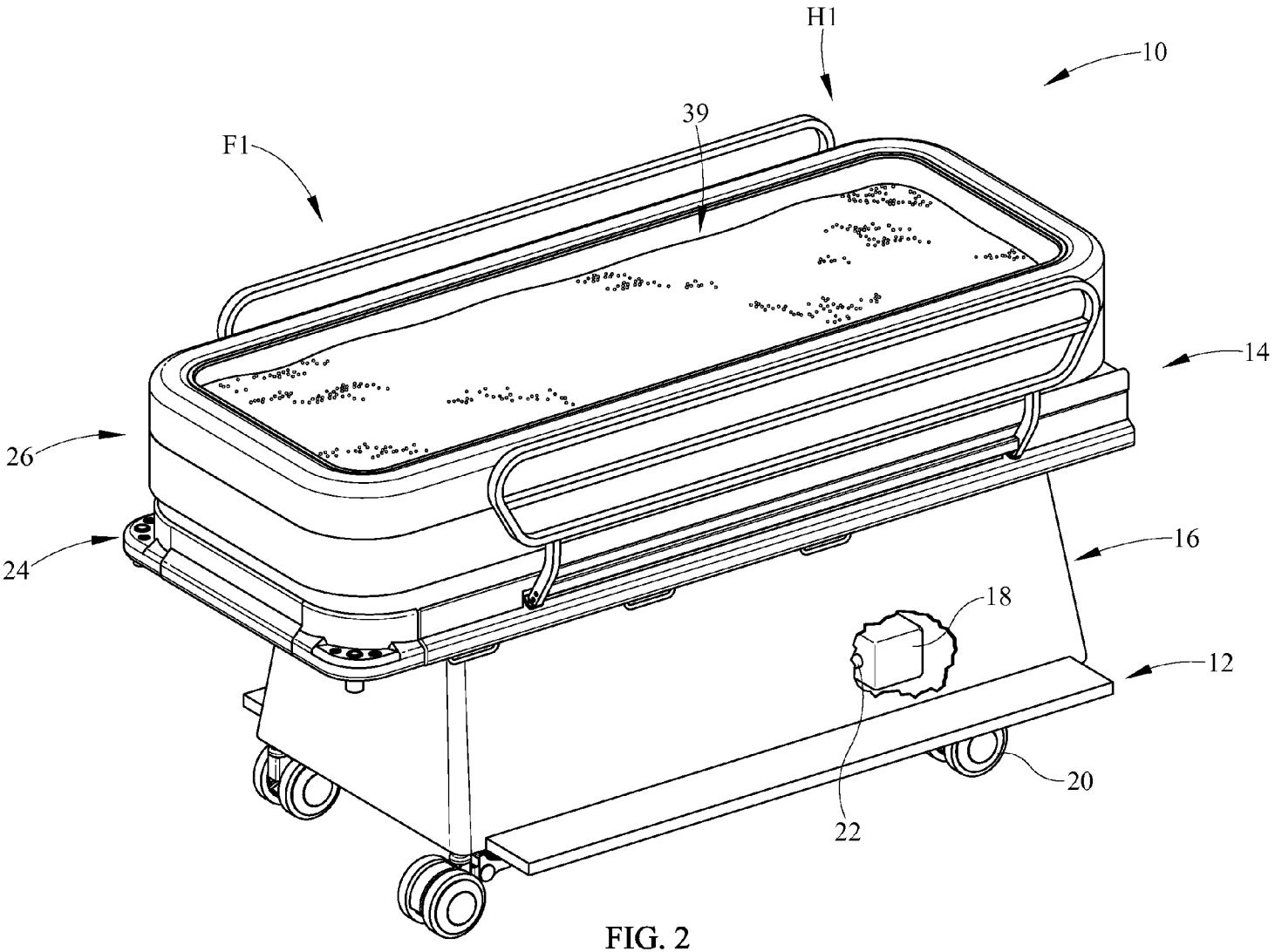
FIG. 2 is a perspective side view of a fluidized person-support apparatus according to another illustrative embodiment.
Figure 3:
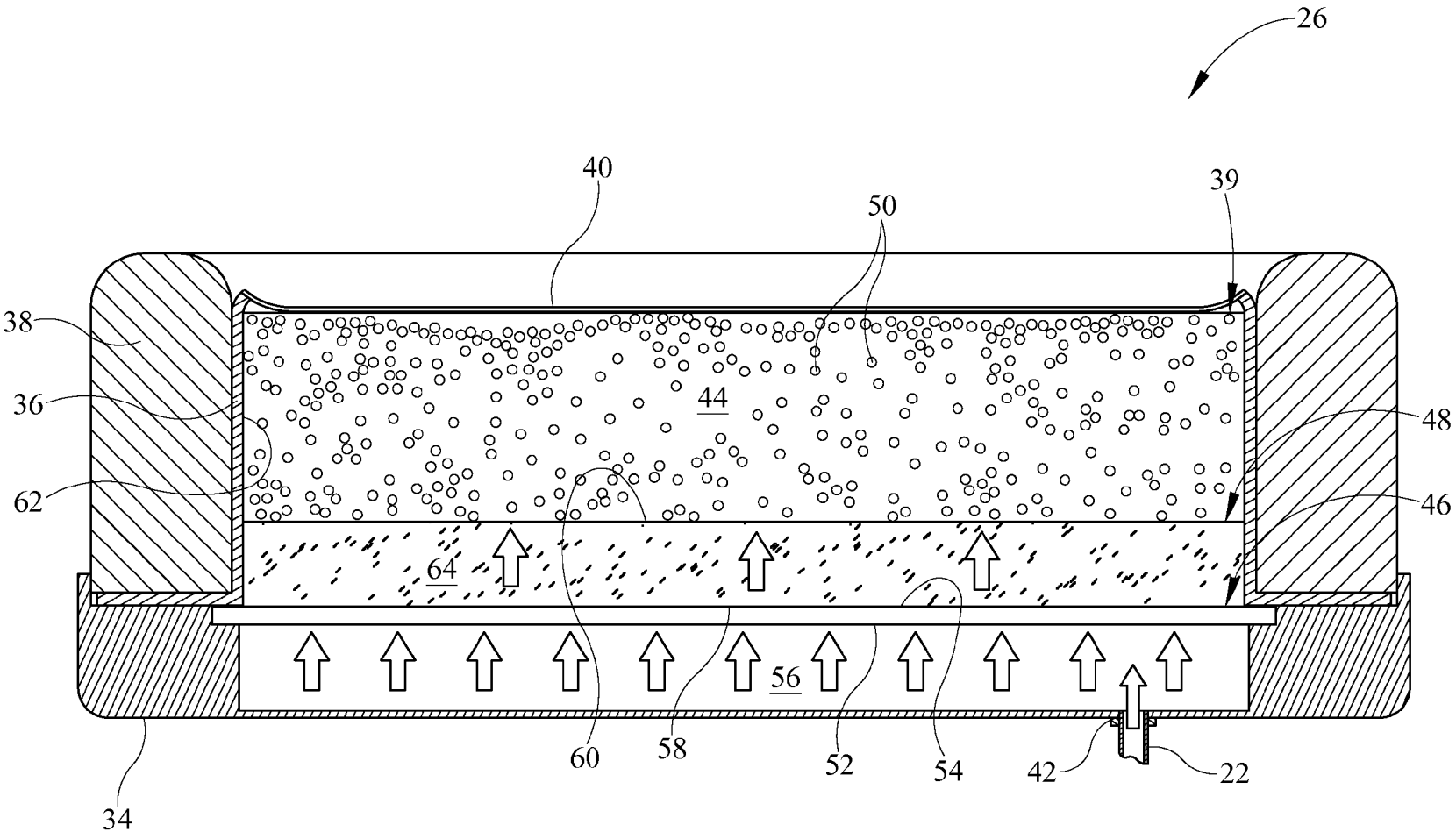
FIG. 3 is a cross-sectional view along lines Y1-Y1 of the tank of FIG. 1 and/or FIG. 2 with a cushion coupled to a diffuser according to one illustrative embodiment.

The gas supply 18 can be integrated into the lower frame 12 and can be configured to supply the gas to the upper frame 14 as shown in FIGS. 1 & 2. It should be appreciated that the gas supply 18 can be removably coupled with or integrated into the upper frame 14 and/or the supports 16. It should also be appreciated that the gas can be remotely supplied, such as, by a head wall unit (not shown). In one illustrative embodiment, the gas supply 18 can be an air blower assembly 18. It should be appreciated that the gas supply 18 can vary the rate at which gas is supplied, as well as the temperature of the gas being supplied. The gas supply unit 18 can be connected to the upper frame 14 through at least one hose 22.

The upper frame 14 can define a longitudinal axis X1 that can extend at least the length of the person-support apparatus 10 through the head end H1 and the foot end F1 along the lateral center of the upper frame 14, and a lateral axis Y1 that can be perpendicular to the longitudinal axis X1 and can extend at least the width of the person-support apparatus 10 through the longitudinal center of the upper frame 14 as shown in FIGS. 1 & 2. It should be appreciated that the head end H1 can be movably coupled to the foot end F1 such that the head end H1 can move with respect to the foot end F1.

In one illustrative embodiment, the upper frame 14 can include an upper frame weldment 24 that can support a tank assembly 26 or container 26 and a head end support assembly 28 as shown in FIG. 1. It should be appreciated that the head end support assembly 28 can articulate with the head end H1 of the upper frame 14 respect to the tank assembly 26. It should also be appreciated that the head end support assembly 28 can be a person-support surface 30 or mattress 30 composed of foam (not shown) and/or having support assembly gas bladders 32. In another illustrative embodiment, the upper frame 14 can include an upper frame weldment 24 that supports a tank assembly 26 as shown in FIG. 2. The head end support assembly 28 of the upper frame 14 can be configured to support a portion of a person's head and/or torso while the tank assembly 26 can be configured to support the pelvic region and lower extremities of a person.

The tank assembly 26 can include a tank base 34, a tank liner 36, a tank bladder 38, and a filter cover 40 or gas permeable cover 40 as shown in FIGS. 3-4 & 6-7. In one illustrative embodiment, the tank base 34 and the tank liner 36 can be made of a low or substantially no air-loss material, such as, for example, a polyurethane-backed nylon fabric material, and the tank bladder 38 can be composed of a substantially no air loss polymeric material and filled with a gas, such as, air. The tank base 34 can be coupled to the upper frame weldment 24 by tank fasteners (not shown) and can include an inlet 42 that can couple with the hose 22. The tank liner 36 and the tank bladder 38 can be coupled together to form the sides of the tank assembly 26. The tank base 34 can be coupled with the tank liner 36 and the tank bladder 38 to define an opening 39 opposite the tank base 34.

The filter cover 40 can be positioned over the opening 39 and can be couple to the tank liner 36 with a cover fastener (not shown) as shown in FIGS. 3-4 & 6-7. It should be appreciated that the cover fasteners can be zippers, buttons, snaps, turn-buttons, Velcro®, or other fasteners. The tank base 34, the tank liner 36, the tank bladder 38, and the filter cover 40 can cooperate to define a chamber 44 therebetween. The chamber 44 can contain a diffuser 46 or gas permeable support 46, a cushion 48, and a fluidizable medium 50 therein. The diffuser 46 can be a porous board that can be permeable to the gas supplied by the gas supply 18, but not permeable to the fluidizable medium 50. The diffuser 46 can be positioned proximate the tank base 34 and can include a first side 52 and a second side 54. The first side 52 of the diffuser 46 can cooperate with tank base 34 to define a plenum 56, and the second side 54 of the diffuser 46 can have a cushion 48 coupled thereto as shown in FIGS. 3-4 & 6-7. The plenum 56 can receive gas from the gas supply 18 through the inlet 42 and can communicate the gas substantially uniformly through the diffuser 46. The gas in the plenum 56 can be pressurized depending on the flow rate from the gas supply 18 and the porosity of the diffuser 46.

The volume between the diffuser 46 and the filter cover 40 can be filled with the fluidizable medium 50 as shown in FIGS. 3-4 & 6-7. In one illustrative embodiment, the fluidizable medium 50 can be spherical silica beads of the type commonly employed in air fluidized bead person-support systems. It should also be appreciated that the fluidizable medium 50 can range in size from about 50 to about 150 microns in diameter, which can depend on the rate at which gas is supplied through the diffuser 46. Similarly, the rate at which gas is supplied through the diffuser 46 can vary as a function of the size of the fluidizable medium 50 and the depth of the fluidizable medium 50, i.e., the distance between the diffuser 46 and the opening 39 or the distance between the cushion 48 and the opening 39.

The cushion 48 can include a first cushion surface 58 and a second cushion surface 60 as shown in FIGS. 3-7. The first cushion surface 58 can be coupled to the second surface 54 of the diffuser 46 with a plurality of cushion fasteners (not shown), and the second cushion surface 60 can contact the fluidizable medium 50. It should be appreciated that side surfaces 62 of the cushion 48 can be coupled to the tank liner 36 with a plurality of fasteners. It should also be appreciated that the fasteners (not shown) can be zippers, buttons, snaps, turn-buttons, Velcro®, adhesive, or other fasteners.

Figure 4:
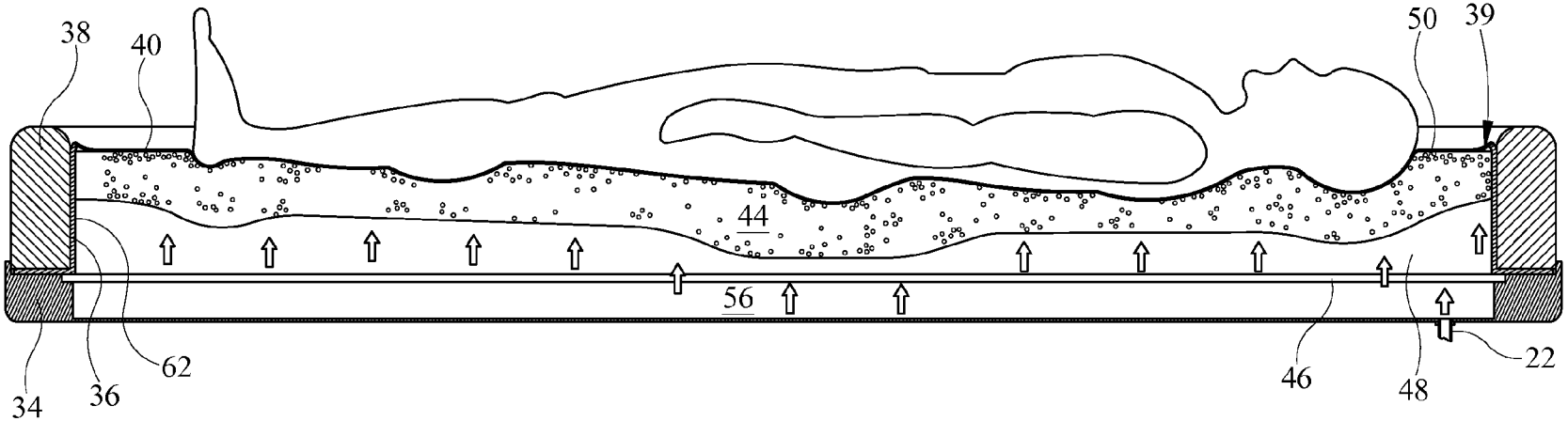
FIG. 4 is a cross-sectional view along lines X1-X1 of the tank of FIG. 2 with the depth of a fluidizable material varying as a function of the profile of a person's body.

The cushion 48 can help prevent people supported on the person-support apparatus 10 from coming into contact with the diffuser 46 as shown in FIGS. 3-4 & 6-7. In one illustrative embodiment, the cushion 48 can be formed to mimic the contour of a person's body such that the distance between the opening 39 and the cushion 48 can be greater below at least one of a head of a person, a lower pelvic region of a person, and a heel of a person when compared to at least one of a torso of a person, a leg of a person, and an arm of a person as shown in FIG. 4.

The cushion 48 can be configured to allow gas to pass therethrough, but not allow the fluidizable medium 50 to pass therethrough. It should be appreciated that the second surface of the cushion 48 can be configured to allow both the gas and the fluidizable medium 50 to pass therethrough. In one illustrative embodiment, the cushion 48 can include a cushion filter cover (not shown) coupled to the second cushion surface 60 that can be configured to allow the gas to pass therethrough, but not allow the fluidizable medium 50 to pass therethrough. In another illustrative embodiment the cushion 48 can have holes therethrough that can allow the gas and the fluidizable material 50 to pass therethrough.

Figure 5:
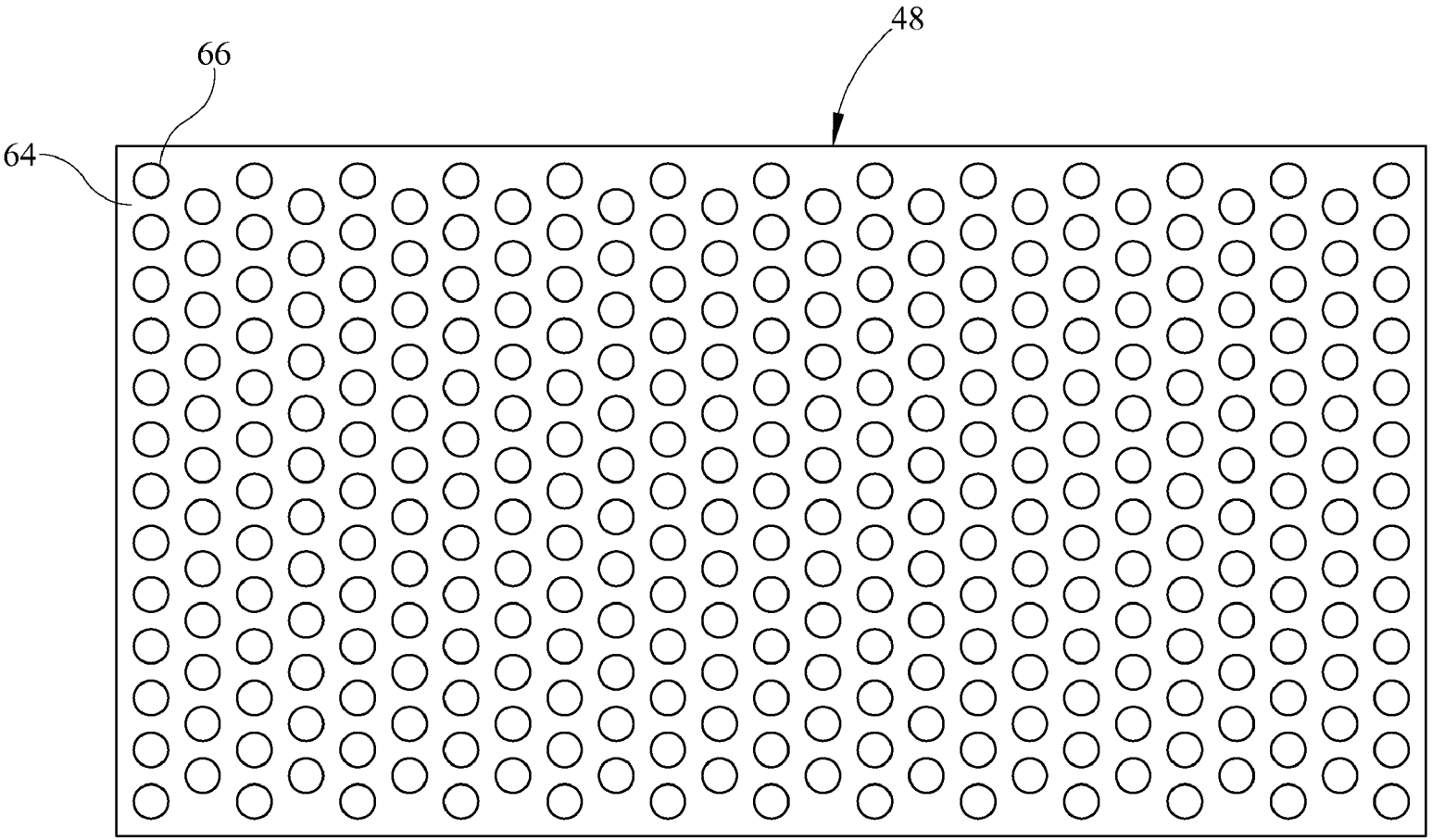
FIG. 5 is a top view of the cushion of FIG. 3 according to one illustrative embodiment.

The cushion 48 can be composed of a material 64 having elastic properties such that the cushion 48 can be compressed under the weight of the fluidizable medium 50 when the fluidizable medium 50 is not fluidized, and can expand from its compressed state when the fluidizable medium 50 is fluidized. In one illustrative embodiment, the cushion 48 can be composed of open cell foam 64. In another illustrative embodiment, the cushion can be composed of closed cell foam 64 with holes 66 therethrough that can be configured to allow the gas and the fluidizable material 50 to pass therethrough as shown in FIG. 5. It should be appreciated that the holes 66 can be 0.5 inches to 1 inch in diameter and positioned less than 0.5 inches apart. It should also be appreciated that the holes 66 can be more or less than 0.5 inches to 1 inch in diameter and can be more or less than 0.5 inches apart, which can depend on the depth of the fluidizable material 50.

Figure 6:
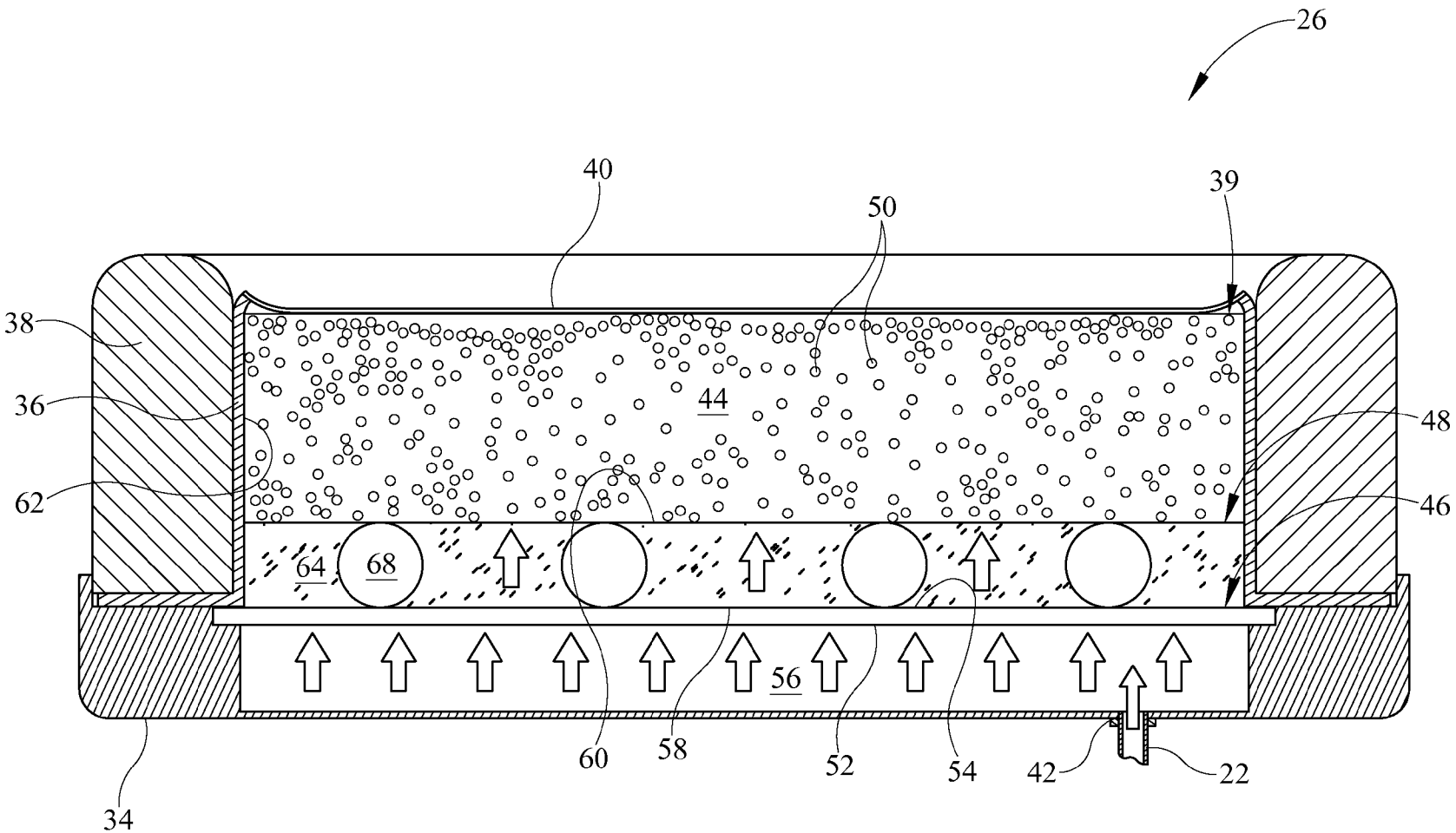
FIG. 6 is a cross-sectional view along lines Y1-Y1 of the tank of FIG. 1 and/or FIG. 2 with a cushion having gas bladders positioned therein coupled to a diffuser according to another illustrative embodiment.

In another illustrative embodiment, the cushion 48 can include the elastic material 64 and a plurality of gas bladders 68, such as, air bladders 68, positioned there within as shown in FIG. 6. The gas bladders 68 can be coupled to the diffuser 46 and can receive gas from the gas supply 18 and can be configured to provide additional support to the cushion 48. It should be appreciated that the gas bladders 68 can receive gas through the diffuser 46. In one illustrative embodiment, the gas bladders 68 can be configured to not appreciably communicate gas to the fluidizable medium 50. In another illustrative embodiment, the gas bladders 68 can be configured to communicate gas to the fluidizable medium 50 such that the rate gas is communicated to the fluidizable material 50 by the gas bladders 68 is insufficient to fluidize the fluidizable material 50 independent the diffuser 46. The gas bladders 68 can be composed of a polymeric material and can be tubular bladders with a circular, rectangular, triangular, or other cross-section.

The gas bladders 68 can be aligned parallel the longitudinal axis X1 and/or the lateral axis Y1.

Figure 7:
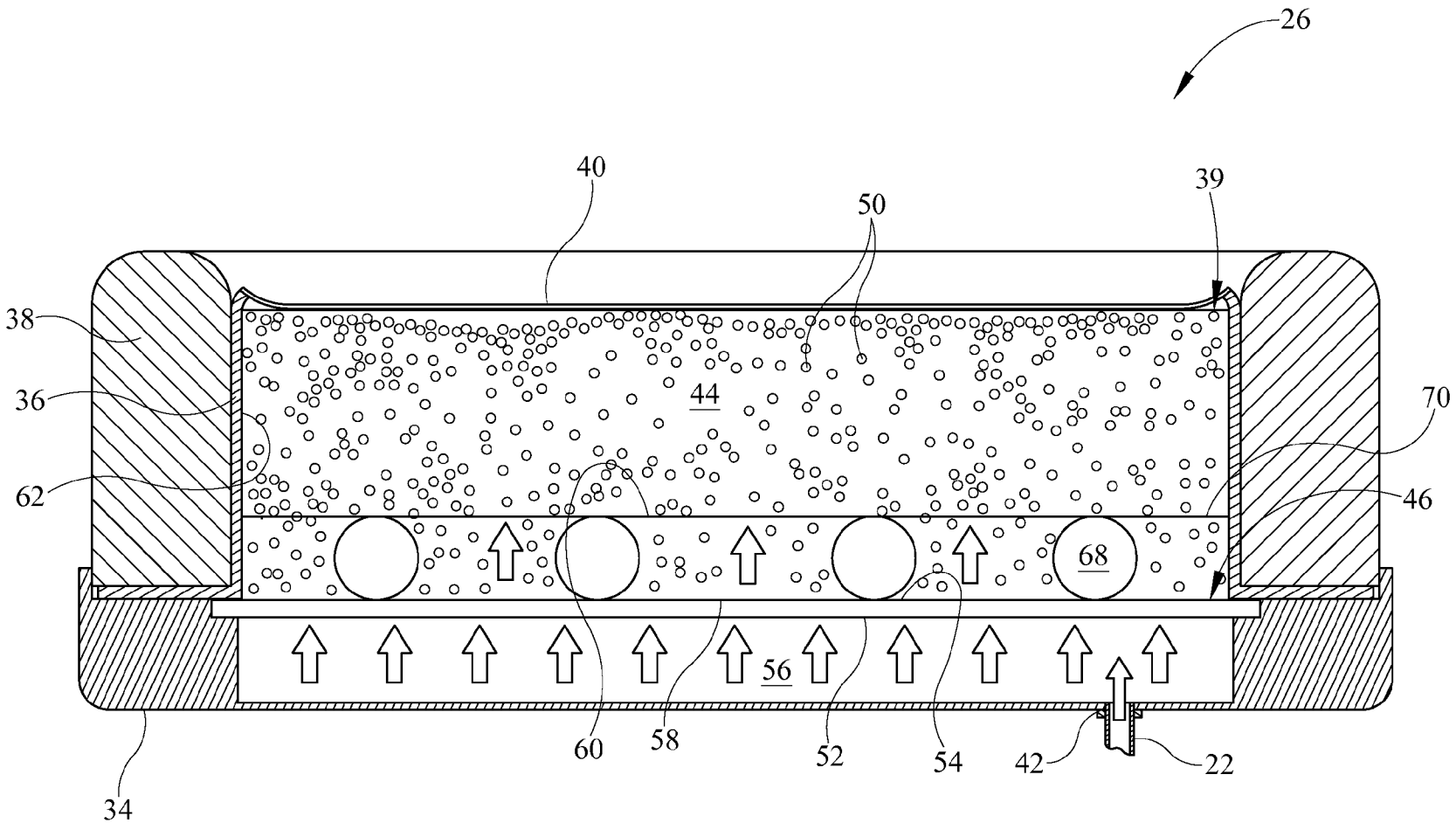
FIG. 7 is a cross-sectional view along lines Y1-Y1 of the tank of FIG. 1 and/or FIG. 2 with gas bladders coupled to a diffuser according to yet another illustrative embodiment.

In yet another illustrative embodiment, the cushion 48 can include a plurality of gas bladders 68 retained below the opening 39 by a retaining element 70 as shown in FIG. 7. In one illustrative embodiment the retaining element 70 can be a net 70 that can be composed of an elastic material. The net 70 can be coupled to the tank liner 36 and/or the tank bladders 34 to retain the gas bladders 68 below the opening 39. It should also be appreciated that the net 70 can be coupled to the diffuser 46 to retain the gas bladders 68 on the second cushion surface 60. The net 70 can be configured to assist with distributing a least a portion of a load to adjacent gas bladders 68.

Figure 8:
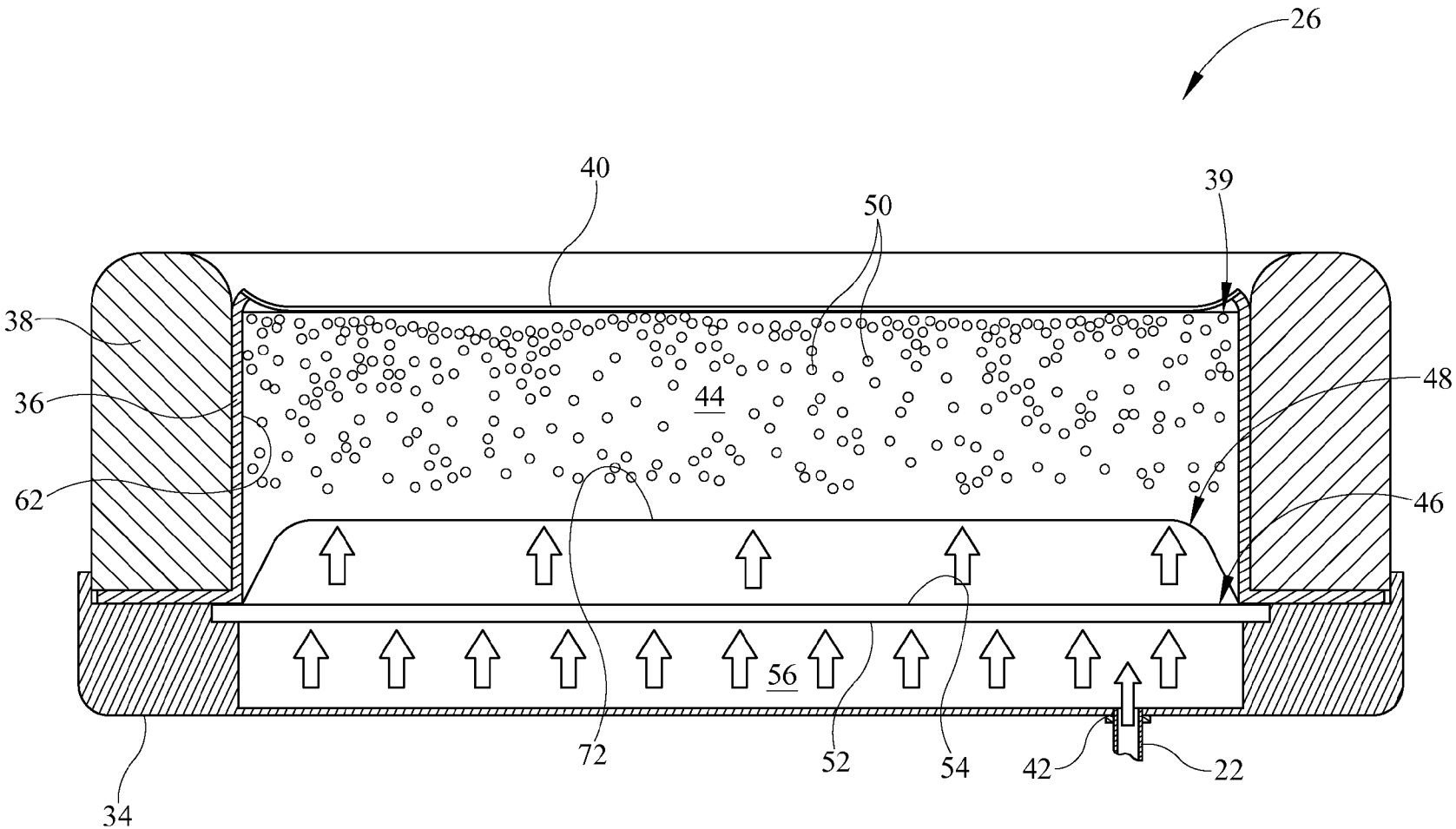
FIG. 8 is a cross-sectional view along lines Y1-Y1 of the tank of FIG. 1 and/or FIG. 2 with a gas permeable cover coupled to a diffuser according to yet another illustrative embodiment.

In still another illustrative embodiment, the cushion 48 can be a gas permeable sheet 72 that can be coupled to the second surface 54 of the diffuser 46 as shown in FIG. 8. It should be appreciated that the second gas permeable sheet 72 can be coupled to the tank liner 36. It should also be appreciated that there can be multiple gas permeable sheets 72 coupled to the diffuser 46 such that they form rows (not shown) extending at least one of parallel, perpendicular, and at an angle with respect to the longitudinal axis X1. In one illustrative embodiment, the gas permeable sheet 72 can be a filter cover as previously described herein. In another illustrative embodiment, the gas permeable sheet 72 can not be an inflatable diffuser. In yet another illustrative embodiment, the gas permeable sheet 72 can be an inflatable diffuser. The gas permeable sheet 72 can inflate when gas is communicated from the plenum 56 through the diffuser 46. The inflated gas permeable sheet 72 can provide cushioning support to a person supported on the person-support apparatus 10.

In operation, the gas supply 18 can supply a gas to the plenum 56. The gas in the plenum 56 can pressurize and can be communicated substantially uniformly through the diffuser 46. The gas can pass through the diffuser 46 and into the cushion 48. The gas can pass through the substantially porous cushion 48 and into the fluidizable medium, which can cause the fluidizable medium to move in such a way that the fluidizable medium takes on some fluid-like characteristics. Accordingly, the person supported on the filter cover 40 can be buoyantly suspended, which can help distribute the supporting pressure points uniformly along the body surface, i.e., increase the surface area of the body being supported. In cases where a person sinks deep enough in the fluidizable medium 50, for example, when the person is sitting up or leaning on an elbow, such that the person can contact the diffuser 46, i.e., bottoms-out, the cushion 48 can help in avoiding direct contact with the diffuser board 42 to maintain a reduced interface pressure compared to the interface pressure of a person contacting the diffuser 46.

Many other embodiments of the present disclosure are also envisioned. For example, a person-support apparatus comprises a container, a gas permeable cover, a gas permeable support, a fluidizable medium, and a cushion. The container is supported on a frame. The container includes a base and a plurality of sides coupled to the base. The base cooperates with the sides to define an opening opposite the base. The gas permeable cover is coupled to the container and positioned over the opening. The gas permeable cover cooperates with the container to define a first chamber. The gas permeable support is positioned within the chamber. The gas permeable support includes a first side and a second side. The first side is spaced apart from the base to define a second chamber. The fluidizable medium is positioned between the second side of the gas permeable support and the gas permeable cover. The cushion is coupled to the second side of the gas permeable support and configured to provide cushioning support between a person supported on the person-support apparatus and the gas permeable support.

In another example, a person-support apparatus comprises a frame, a container, a gas permeable cover, a rigid diffuser, a fluidizable medium, and a cushion. The container is supported on a frame and includes a base and a plurality of sides coupled to the base. The base cooperates with the sides to define an opening opposite the base. The gas permeable cover is removably coupled to the container and covers the opening to define a chamber. The rigid diffuser is positioned within the chamber proximate the base. The fluidizable medium is positioned between the rigid diffuser and the gas permeable cover. The cushion is coupled to the diffuser and positioned between the gas permeable cover and the rigid diffuser. The cushion is configured to provide cushioning support between a person supported on the gas permeable cover and the rigid diffuser.

In yet another example, a person-support apparatus comprises a container, a gas permeable cover, a gas permeable support, a gas supply, a cushion, and a fluidizable medium. The container is supported on a frame. The container includes a base and a plurality of sides coupled to the base. The base cooperates with the plurality of sides to define an opening opposite the base. The gas permeable cover is removably coupled to the container and covering the opening to define a chamber. The gas permeable support is positioned within the chamber proximate the base. The gas supply is configured to supply gas to the chamber. The cushion includes a first surface coupled to the gas permeable support and positioned between the gas permeable support and the gas permeable cover. The fluidizable medium is positioned between the gas permeable support and the gas permeable cover. The person support apparatus is configured such that gas from the gas supply flows into the chamber, flows through the gas permeable support, flows one of around and through the cushion, flows through the fluidizable medium to fluidize the fluidizable medium, and exits through the gas permeable cover.

In still another example, a person-support apparatus comprises a container, a gas permeable cover, a rigid diffuser, a gas permeable sheet, and a fluidizable medium. The container is supported on a frame. The container includes a base and a plurality of sides coupled to the base. The base cooperates with the plurality of sides to define an opening opposite the base. The gas permeable cover is removably coupled to the container and covers the opening to define a chamber. The rigid diffuser is positioned within the chamber proximate the base. The gas permeable sheet is coupled within the chamber between the rigid diffuser and the gas permeable cover. At least a portion of the gas permeable sheet is inflatable and is configured to provide cushioning support between a person supported on the gas permeable cover and the rigid diffuser. The fluidizable medium is positioned between the gas permeable sheet and the gas permeable filter cover.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A person-support apparatus, the person-support apparatus comprising:

a container supported on a frame, the container including a base and a plurality of sides coupled to the base, the base cooperating with the sides to define an opening opposite the base;

a gas permeable cover coupled to the container and positioned over the opening, the gas permeable cover cooperating with the container to define a first chamber;

a gas permeable support positioned within the chamber, the gas permeable support including a first side and a second side, wherein the first side is spaced apart from the base to define a second chamber;

a fluidizable medium positioned between the second side of the gas permeable support and the gas permeable cover; and a cushion coupled to the second side of the gas permeable support and configured to provide cushioning support between a person supported on the person-support apparatus and the gas permeable support, wherein the thickness of the cushion varies over a portion of the cushion.

2. The person-support apparatus of claim 1, wherein the cushion has elastic properties.

3. The person-support apparatus of claim 1, wherein the cushion is composed of open-cell foam.

4. The person-support apparatus of claim 1, wherein the cushion is composed of closed-cell foam, the cushion having a plurality holes therethrough to allow gas to be communicated from the gas permeable support to fluidize the fluidizable medium.

5. The person-support apparatus of claim 1, wherein the cushion is configured to allow fluidizable medium to be passed therethrough.

6. The person-support apparatus of claim 1, wherein the cushion is configured to not allow fluidizable medium to be passed therethrough.

7. The person-support apparatus of claim 6, wherein the cushion includes a first side coupled to the second side of the gas permeable support and a second side with a second gas permeable cover coupled thereto, the gas permeable cover being configured to prevent the fluidizable medium from passing through the cushion.

8. The person-support apparatus of claim 1, wherein the cushion is shaped to mimic the contour of a body of a person.

9. The person-support apparatus of claim 8, wherein the distance between the opening and the cushion is greater below at least one of a head of a person, a lower pelvic region of a person, and a heel of a person when compared to at least one of a torso of a person, a leg of a person, and an arm of a person.

10. The person-support apparatus of claim 1, wherein the frame includes an upper frame supported above a lower frame by at least a support, the upper frame including a first section and a second section, the first section being movable with respect to the second section, the first section supporting a plurality of gas bladders thereon and the second section supporting the container thereon.

11. The person-support apparatus of claim 1, wherein the cushion includes a plurality of gas bladders.

12. The person-support apparatus of claim 11, wherein the cushion includes a retainer configured to retain the gas bladders below the opening.

13. The person-support apparatus of claim 12, wherein the retainer is configured to distribute a load applied to the retainer to at least one adjacent gas bladder.

14. The person-support apparatus of claim 1 further comprising a gas supply, wherein the gas supply is configured to supply gas to at least one of the container and the cushion.

15. The person-support apparatus of claim 1, wherein the cushion is configured to prevent the gas permeable cover from contacting the gas permeable support.

16. The person-support apparatus of claim 1, wherein the gas permeable support is a rigid diffuser board.

17. A person-support apparatus, the person-support apparatus comprising:

a container supported on a frame and including a base and a plurality of sides coupled to the base, the base cooperating with the sides to define an opening opposite the base;

a gas permeable cover removably coupled to the container and covering the opening to define a chamber;

a rigid diffuser positioned within the chamber proximate the base;

a fluidizable medium positioned between the rigid diffuser and the gas permeable cover; and a cushion coupled to the diffuser and positioned between the gas permeable cover and the rigid diffuser, the cushion being configured to provide cushioning support between a person supported on the gas permeable cover and the rigid diffuser and includes a plurality of gas bladders.

18. The person-support apparatus of claim 17, wherein the cushion also includes a portion that is composed of foam.

19. The person-support apparatus of claim 17, wherein the cushion also includes foam and the plurality of gas bladders are positioned within the foam.

20. The person-support apparatus of claim 17, wherein the plurality of as bladder do not a appreciably communicate gas to the fluidizable medium.

21. The person-support apparatus of claim 17, wherein the cushion prevents the gas permeable cover from contacting the rigid diffuser.

22. A person-support apparatus, the person-support apparatus comprising:

a container supported on a frame, the container including a base and a plurality of sides coupled to the base, the base cooperating with the plurality of sides to define an opening opposite the base;

a gas permeable cover removably coupled to the container and covering the opening to define a chamber;

a gas permeable support positioned within the chamber proximate the base;

a gas supply configured to supply gas to the chamber;

a cushion including a first surface coupled to the gas permeable support and positioned between the gas permeable support and the gas permeable cover, the cushion being substantially air impermeable and having a plurality of holes therethrough that allow gas from the gas permeable support to be communicated therethrough; and a fluidizable medium positioned between the gas permeable support and the gas permeable cover, wherein the person support apparatus is configured such that gas from the gas supply flows into the chamber, flows through the gas permeable support, flows one of around the cushion and through the plurality of holes in the cushion, flows through the fluidizable medium to fluidize the fluidizable medium, and exits through the gas permeable cover.

23. The person-support apparatus of claim 22, wherein the cushion includes a gas bladder.

24. The person-support apparatus of claim 23, wherein the gas bladder is configured to supply gas to the fluidizable medium at a rate insufficient to fluidize the fluidizable medium independent of the gas permeable support supplying gas to the fluidizable medium.

25. The person-support apparatus of claim 22, wherein the cushion has elastic properties.

26. The person-support apparatus of claim 22, wherein the cushion is composed of foam.

27. A person-support apparatus, comprising:

a container supported on a frame, the container including a base and a plurality of sides coupled to the base, the base cooperating with the plurality of sides to define an opening opposite the base;

a gas permeable cover removably coupled to the container and covering the opening to define a chamber;

a rigid diffuser positioned within the chamber proximate the base;

a gas permeable sheet coupled within the chamber between the rigid diffuser and the gas permeable cover, wherein at least a portion of the gas permeable sheet is inflatable and is configured to provide cushioning support between a person supported on the gas permeable cover and the rigid diffuser; and a fluidizable medium positioned between the gas permeable sheet and the gas permeable filter cover.

28. The person-support apparatus of claim 27, wherein the gas permeable sheet is coupled to the container.

29. The person-support apparatus of claim 27, wherein the gas permeable sheet is not an inflatable diffuser.

* * * * *